US005735464A

United States Patent [19]

Darrach, III

[11] Patent Number: 5,735,464

[45] Date of Patent: Apr. 7, 1998

[54] NOZZLE PROTECTOR FOR AEROSOL SPRAY CANS

[76] Inventor: Nelson Darrach, III, 12 Sanders St., St. Johnsville, N.Y. 13452

[21] Appl. No.: 431,572

[22] Filed: May 1, 1995

[51] Int. Cl.[6] ..... B67D 5/06

[52] U.S. Cl. ..... 239/288.5; 239/337; 222/182

[58] Field of Search ..... 222/402.12, 402.13, 222/182; 239/288–288.5, 337

[56] References Cited

U.S. PATENT DOCUMENTS

| | | | |
|---|---|---|---|
| D. 203,775 | 2/1966 | Fahlstrom . | |
| D. 203,894 | 2/1966 | Klun . | |
| 2,961,128 | 11/1960 | Cochran | 222/182 |
| 3,107,033 | 10/1963 | Sanborn . | |
| 3,139,223 | 6/1964 | Kruck . | |
| 3,153,497 | 10/1964 | Sagarin . | |
| 3,212,718 | 10/1965 | Green | 222/182 |
| 3,235,132 | 2/1966 | Patton et al. . | |
| 3,512,682 | 5/1970 | Hendrickson et al. . | |
| 3,589,570 | 6/1971 | Gach | 222/402.13 |
| 3,628,699 | 12/1971 | Hendrickson | 222/182 |
| 3,674,184 | 7/1972 | Ewald . | |
| 3,734,354 | 5/1973 | Gack . | |
| 3,851,803 | 12/1974 | Grothoff | 222/402.12 |
| 4,620,646 | 11/1986 | Crapser . | |

FOREIGN PATENT DOCUMENTS

| | | | |
|---|---|---|---|
| 1306054 | 9/1962 | France | 222/402.13 |

*Primary Examiner*—Kevin Weldon

*Attorney, Agent, or Firm*—Baker & Botts, L.L.P.

[57] ABSTRACT

A nozzle protector for an aerosol spray can of the type having in a top portion an annular bead that surrounds a nozzle and defines an inwardly facing groove shields the nozzle from impacts. The protector has a retaining sleeve portion having an upper part adapted to lie radially within the bead, and a pair of snap-in retaining rib portions projecting outwardly in generally opposite directions from the sleeve portion and adapted to be captured in the groove of the can top to securely attach the protector to the can. A pair of nozzle-protecting side wall portions adjoin the upper edge part of the retaining sleeve portion and are configured to define a first opening shaped and dimensioned to permit a spray to be ejected from the nozzle and a second opening shaped and dimensioned to permit a finger of a user to be received inwardly of the wall portions and engage the nozzle. The upper edges of the wall portions are positioned to be located above an uppermost extremity and on generally diametrically opposite sides of the nozzle so that the upper edges of the protector wall portions absorb impacts from all directions and prevent impacts on the nozzle.

11 Claims, 1 Drawing Sheet

NOZZLE PROTECTOR FOR AEROSOL SPRAY CANS

BACKGROUND OF THE INVENTION

Aerosol spray cans of the type that contain a liquid substance and a hydrocarbon propellant are widely used for a broad range of products, such as spray paints, cleaning materials and insecticides, to name just a few examples. Although the designs of the cans vary somewhat, most of them have a dome-like top joined to the perimeter of a circular cylindrical can body and a nozzle receptacle at the upper center of the dome, which is formed with an annular bead. The bead is concentric to the axis of a valve/delivery tube, which passes though a closure wall that is recessed below the rim of the bead. A push button/nozzle piece is affixed to the delivery tube, which for simplicity is referred to hereinafter as a "nozzle." The nozzle is usually made of plastic and extends up from the top of the can such that it is exposed for discharge of a spray above the can top and for manipulation.

Some spray cans have permanent false top caps that are attached to the can at the rim of the circular cylindrical can body and are configured to protect the nozzle from impacts, the nozzle being recessed below the upper ends of portions of the false cap. Other cans, perhaps the majority, have a removable cover that snaps onto the rim and protects the nozzle when the product is transported and stored and is removed from the can when the product is used. When the cap is removed, the nozzle is fully exposed in all directions. While that makes it easy and convenient to use the product, it also presents the risk that the product may be released accidently, such as by the nozzle striking something or the can being dropped. Accidental release of a product such as paint can be, to put it mildly, disconcerting. The exposed nozzle is also prone to being broken off or separated from the discharge tube upon an impact, which often renders the can useless and wastes the product.

SUMMARY OF THE INVENTION

One object of the present invention is to provide a protector for an aerosol can of the type having a fully exposed nozzle that protects the nozzle from impacts from any direction, thereby preventing accidental discharges of the product the can contains and damage or detachment of the nozzle. It is also an object of the invention to provide a nozzle protector that does not diminish the spray-dispensing function of the can or make it harder to operate the valve. Another object is to provide, a nozzle protector that can be installed on such an aerosol can without having to modify it in any way. Still a further object is to provide a protector than can be removed from one can and installed on another can.

The foregoing objects are attained, in accordance with the present invention, by a nozzle protector for an aerosol spray can of the type having in a top portion an annular bead that surrounds a nozzle and defines an inwardly facing groove. The nozzle protector, which shields the nozzle from impacts, has a retaining sleeve portion, an upper edge part of which lies radially inwardly of the bead. Snap-in retaining rib portions project outwardly from the sleeve portion and are configured to be captured in the groove of the can top below the bead to securely attach the protector to the can. A pair of nozzle-protecting side wall portions adjoin the upper part of the retaining sleeve portion and are configured to define a first opening shaped and dimensioned to permit a spray to be ejected from the nozzle and a second opening shaped and dimensioned to permit a finger of a user to be received inwardly of the wall portions and engage the nozzle. The upper edges of the wall portions are positioned on the protector to be located above an uppermost extremity and on generally diametrically opposite sides of the nozzle so that the upper edges of the protector wall portions absorb impacts from all directions and prevent impacts on the nozzle.

In preferred embodiments, each retaining rib portion has a peripheral outwardly facing camming surface that diverges outwardly and upwardly relative to a lower edge of the retaining sleeve portion, the camming surface being configured to enable the protector to be attached to the can by pushing it firmly into the bead, and a shoulder surface facing generally upwardly relative to the lower edge of the retaining sleeve portion and forming a juncture with the camming surface, the shoulder surface being adapted to retain the rib portion in the groove when the protector is attached to the can. The retaining sleeve portion is, preferably, resilient so that pushing it into the bead of the can top is facilitated and so that the protector can be detached from the bead. Resiliency of the retaining sleeve portion may be imparted by at least two slits extending generally orthogonally to a plane of the lower edge, such as by two slits located substantially diametrically opposite each other.

The wall portions may be segments of a substantially circular cylinder having an axis coextensive with an axis of the retaining sleeve portion. Optionally but preferably, the wall portions adjoin each other along junctures proximate to the retaining sleeve portion. To enhance the ease of engaging the nozzle with a finger to dispense the contents of the can, the wall portions have a diameter greater than that of the collar portion, in which case, the protector further has an annular connecting wall portion joining the collar portion and wall portions and lying substantially in a plane orthogonal to the axis of the cylinder.

The annular connecting portion can, to advantage, be located in closely spaced relation to the bead when the protector is attached to the can, thereby facilitating removal of the protector by inserting an implement, such as the tip of a screwdriver, between the bead and the annular connecting portion and prying off the protector.

Although a protector embodying the invention may be made of any durable material and by various manufacturing techniques, and may consist of separate components suitably joined, it is, advantageously, monolithic and unitary and made from a substantially rigid polymeric material that has an impact resistance and strength sufficient to resist fracture when the can with the protector attached is dropped from a height of several feet.

With the features described above, especially as embodied in the preferred embodiment described below, the nozzle is protected from impacts from all directions. Accordingly, accidental discharge of the contents and breakage or detachment of the nozzle due to an impact when the can is mishandled and strikes an object or when it is dropped are prevented. The openings in the protective side walls, however, do not impede proper discharge of the contents when the can is used, and normal access to the nozzle by the finger of a user is not interfered with. The configuration of the protector makes is easy to manufacture by mass production using a small amount of material, thus making it inexpensive to produce. No modification whatsoever to the aerosol can is required to enable the protector to be attached to it. The protector can be provided on cans by the manufacturer or sold separately for installation and use by a consumer. In either case, it can be removed from one can and installed on another can.

For a better understanding of the invention, reference may be made to the following description of an exemplary embodiment, taken in conjunction with the accompanying drawings.

DESCRIPTION OF AN EMBODIMENT

Figure 1:
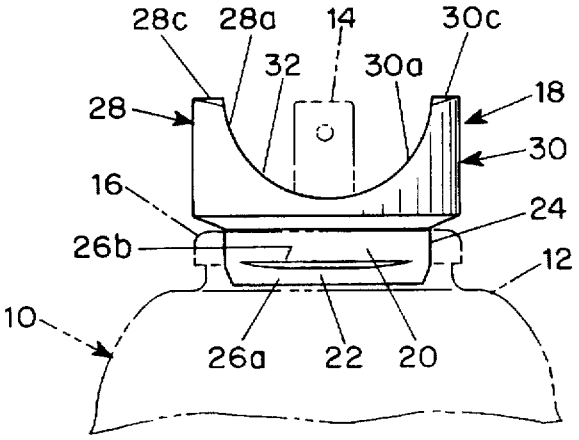
FIG. 1 is a front elevational view of the embodiment, showing it installed on an aerosol container.
Figure 2:
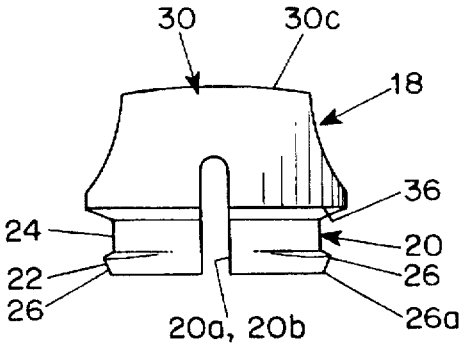
FIG. 2 is a side elevational view.
Figure 3:
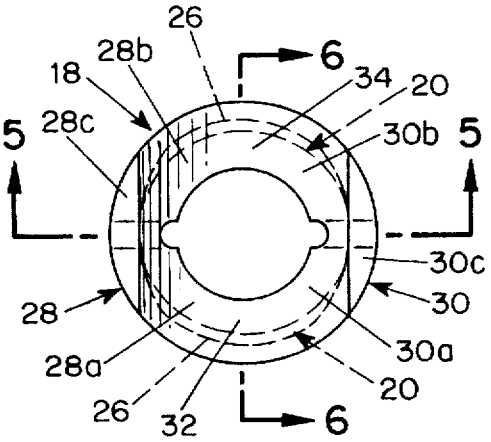
FIG. 3 is a top plan view.
Figure 4:
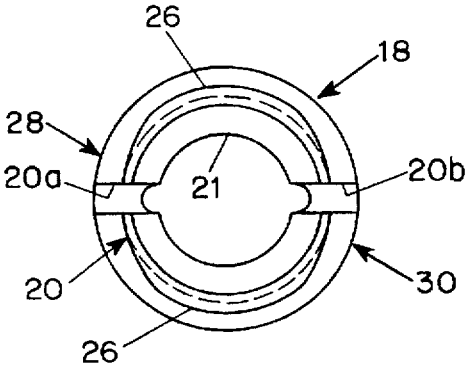
FIG. 4 is a bottom plan view.

FIG. 1 shows in phantom lines and in schematic form (without details) the top portion of a conventional aerosol can 10. Typically, cans of the type with which the present invention is used have a dome-like top closure 12 that is attached by a rolled over and sealed joint to a circular cylindrical can body (not shown). A discharge valve and discharge tube assembly is received by a circular valve-mounting plate (not shown), which is recessed into the center of the top closure. The discharge tube receives a push button/discharge nozzle member ("nozzle") 14. The valve mounting plate is joined to the top closure by a rolled seam 16 formed by flange portions at a receiving opening in the top closure and at the perimeter of the mounting plate. That seam creates an annular bead, which is concentric with the discharge tube and projects or overhangs slightly the perimeter flange on the valve-mounting plate, thus forming an inwardly opening, shallow groove below it and within the recess in the can top structure. The present invention makes use of the recess and groove as an attachment site for the protector. The reader will better understand the form of the bead and groove by examining a typical aerosol can of the type shown generally in FIG. 1. Those skilled in the art are familiar with the structure of such a can.

The embodiment of the protector 18 shown in the drawings has a retaining sleeve portion 20 that defines a hole 21 through which the nozzle 14 extends. An upper part 24 lies radially within and in contact with the bead 16. A pair of snap-in retaining rib portions 26 project outwardly from the sleeve portion 22 and are configured to be captured in the groove below the bead 16. A pair of nozzle-protecting side wall portions 28 and 30 are joined to the upper part 24 of the retaining sleeve portion 20.

Figure 5:
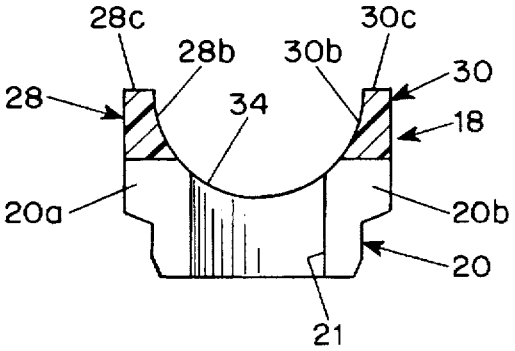
FIG. 5 is an axial side elevational view, taken along the lines 5—5 of FIG. 3.
Figure 6:
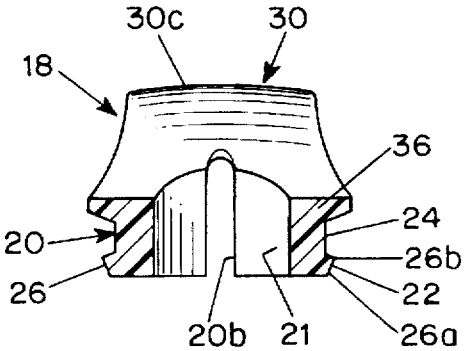
FIG. 6 is an axial front elevational view, taken along the lines 6—6 of FIG. 3.

The wall portions 28 and 30 have edges **28*a* and 30*a* defining a first opening 32 (FIG. 1) that is shaped and dimensioned to permit a spray to be ejected from the nozzle and outwardly of the wall portions when the protector is attached to the can. Similarly, the walls portions have edges 28*b* and 30*b* defining a second opening 34 (FIG. 5), which is suitably shaped and dimensioned to permit a finger of a user to be received inwardly of the wall portions and engage the nozzle when the protector is attached to the can. In the embodiment, the edges 28*a*, 30*a* and 28*b*, 30*b* define portions of a circular cylindrical surface, and the openings 32 and 34 are identical, which permits the protector to be installed in two positions on a can. The shapes and sizes of the openings can, of course, be different. The wall portions 28 and 30 have upper edges 28*c* and 30*c* that are positioned to be located above an uppermost extremity and on generally diametrically opposite sides of the nozzle 14** of the can when the protector is attached to the can.

Each retaining rib portion 26 extends along a portion of the lower edge of the retaining sleeve portion 20, the rib portions being diametrically opposite each other, and has a peripheral outwardly facing camming surface **26*a* diverging outwardly and upwardly relative to the lower edge of the retaining sleeve portion. The camming surface 26*a* enables the protector to be attached to the can by pushing it into the recess within the bead 14, the surface 26*a* causing the rib portion to deflect and deform radially inwardly so that it can pass by the overhang of the groove formed by the bead 16 of the can top and ultimately snap back out into a retained position. A shoulder surface 26*b* facing generally upwardly relative to the lower edge of the retaining sleeve portion and forming a juncture with the camming surface 26*a* firmly retains the rib portion in the groove and keeps the protector attached to the can, even when fairly severe impacts are applied obliquely to the upper ends 28*c* or 30*c***.

The retaining sleeve portion 20 is sufficiently resilient to allow it to be forced into the recess and, also, so that it can be detached from the bead, as described below. Resilience is imparted by two identical slits **20*a* and 20*b*** in the sleeve portion located substantially diametrically opposite each other.

The wall portions 28 and 30 adjoin each other at junctures proximate to the retaining sleeve portion and are vestigial parts of a circular cylindrical body that are left when the openings 32 and 34 are formed. The upper edges **28*c* and 30*c* project above the top of the nozzle and protect the nozzle from impacts from any direction. The wall portions have a diameter greater than that of the collar portion and the openings 32 and 34** are large in order to provide an easy access to the nozzle when the can is used.

An annular connecting wall portion 36 lying substantially in a plane orthogonal to the axis of the cylinder joins the sleeve portion 20 and wall portions 28 and 30. The slits **20*a* and 20*b* transect the connecting wall portion and a small lower part of each side wall portion 28 and 30 in order to allow the retaining sleeve portion to deflect more readily. The annular connecting portion 36 forms a shoulder located in closely spaced relation to the bead 16** of the can when the protector is attached to the can, thereby facilitating removal of the can by inserting an implement, such as a screwdriver, between the bead and the annular connecting portion and prying off the protector.

It is preferred to make the protector of a rigid, impact resistant polymeric material, such as nylon, Delrin, polyvinyl chloride modified with an acrylic for toughness, or any of a large number of suitable polymeric materials recognized for toughness and fracture resistance.

It will be readily apparent to those skilled in the art that the shapes and sizes of the protector and of its various features can be modified without diminishing the performance characteristics. Modifications of that nature are intended to be within the scope of the invention, as set forth in the appended claims.

I claim:

1. A nozzle protector for an aerosol spray can of the type having in a top portion an annular bead that surrounds a nozzle and is formed by a rolled seam between a dome-like top closure of the can and a circular valve-mounting plate and defines with the valve-mounting plate an inwardly-opening annular groove, the protector having a retaining sleeve portion having an upper part adapted to lie radially within the bead and a pair of snap-in retaining rib portions projecting outwardly in generally opposite directions and adapted to be received in and captured by the groove, and a pair of nozzle-protecting side wall portions joined to the upper part of the retaining sleeve portion, the wall portions having outer surfaces that are segments of a substantially circular cylinder having an axis coextensive with an axis of the retaining sleeve portion, that adjoin each other along junctures proximate to the retaining sleeve portion, and that have a diameter greater than that of the retaining sleeve portion, first edges defining a first opening shaped and dimensioned to permit a spray to be ejected from the nozzle and outwardly of the wall portions when the protector is attached to the can, second edges defining a second opening shaped and dimensioned to permit a finger of a user to be received inwardly of the wall portions and engage the nozzle when the protector is attached to the can, and upper edges positioned to be located above an uppermost extremity and on generally diametrically opposite sides of the nozzle when the protector is attached to the can.

2. A nozzle protector according to claim 1 wherein each retaining rib portion has a peripheral outwardly facing camming surface diverging outwardly and upwardly relative to a lower edge of the retaining sleeve portion, the camming surface being adapted to enable the protector to be attached to the can by pushing it into the bead, and each retaining rib portion has a shoulder surface facing generally upwardly relative to the lower edge of the retaining sleeve portion and forming a juncture with the camming surface, the shoulder surface being adapted to retain the rib portion in the groove when the protector is attached to the can.

3. A nozzle protector according to claim 2 wherein the retaining sleeve portion is resilient so that pushing it into the bead is facilitated and so that the protector can be detached from the bead.

4. A nozzle protector according to claim 3 wherein the wall portions have an annular shoulder located in closely spaced relation to the bead when the protector is attached to the can, thereby facilitating removal of the can by insertion of an implement between the bead and the annular shoulder and prying off the protector.

5. A nozzle protector according to claim 4 wherein the retaining sleeve portion has at least two slits extending generally orthogonally to a plane of the lower edge.

6. A nozzle protector according to claim 5 wherein there are two slits located substantially diametrically opposite each other.

7. A nozzle protector according to claim 6 wherein the slits transect the retaining sleeve portion in its entirety.

8. A nozzle protector according to claim 7 wherein the protector is monolithic.

9. A nozzle protector according to claim 8 wherein the protector is of a substantially rigid polymeric material.

10. A nozzle protector according to claim 8 wherein the polymeric material is an impact-resistant polymeric material.

11. A nozzle protector for an aerosol spray can of the type having in a top portion an annular bead that surrounds a nozzle and defines an inwardly facing groove, the protector being unitary and of an impact-resistant polymeric material and having a retaining sleeve portion having an upper part adapted to lie radially within the bead, the retaining sleeve portion being resilient so that pushing it into place within the bead is facilitated and so that the protector can be detached from the bead, and the retaining sleeve portion having at least two slits extending generally orthogonally to a plane of a lower edge, there being two slits located substantially diametrically opposite each other, and the retaining sleeve portion having a pair of snap-in retaining rib portions projecting outwardly in generally opposite directions and adapted to be received in the groove, the retaining rib portions being intermediate of the slits and each retaining rib portion having a peripheral outwardly facing camming surface diverging outwardly and upwardly relative to a lower edge of the retaining sleeve portion, the camming surface being adapted to enable the protector to be attached to the can by pushing it into the bead, and a shoulder surface facing generally upwardly relative to the lower edge of the retaining sleeve portion and forming a juncture with the camming surface, the shoulder surface being adapted to capture the rib portion in the groove when the protector is attached to the can, and a pair of nozzle-protecting side wall portions joined to the upper edge part of the retaining sleeve portion, the wall portions having first edges defining a first opening shaped and dimensioned to permit a spray to be ejected from the nozzle and outwardly of the wall portions when the protector is attached to the can, second edges defining a second opening shaped and dimensioned to permit a finger of a user to be received inwardly of the wall portions and engage the nozzle when the protector is attached to the can, and upper edges positioned to be located above an uppermost extremity and on generally diametrically opposite sides of the nozzle when the protector is attached to the can, the wall portions being segments of a substantially circular cylinder having an axis coextensive with an axis of the retaining sleeve portion, adjoining each other along junctures proximate to the retaining sleeve portion, and having a diameter greater than that of the retaining sleeve portion, and the protector further has an annular connecting wall portion joining the retaining sleeve portion and wall portions and lying substantially in a plane orthogonal to the axis of the cylinder.

* * * * *